US007343641B2

(12) United States Patent
Shanor

(10) Patent No.: US 7,343,641 B2
(45) Date of Patent: Mar. 18, 2008

(54) DIRT COLLECTION ASSEMBLY WITH VOLCANIC AIRFLOW

(75) Inventor: Michael J. Shanor, Nicholasville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 630 days.

(21) Appl. No.: 10/686,920

(22) Filed: Oct. 16, 2003

(65) Prior Publication Data

US 2004/0083573 A1 May 6, 2004

Related U.S. Application Data

(60) Provisional application No. 60/419,659, filed on Oct. 18, 2002.

(51) Int. Cl.
*A47L 5/00* (2006.01)
*A47L 11/00* (2006.01)

(52) U.S. Cl. ..... 15/327.2; 15/352; 15/353; 55/413; 55/492; 55/DIG. 3

(58) Field of Classification Search ..... 15/327.1, 15/327.2, 327.3, 327.4, 327.5, 327.6, 327.7, 15/347, 350–353, 487, DIG. 3; 55/320, 55/323, 462, 465, 486
See application file for complete search history.

(56) References Cited

U.S. PATENT DOCUMENTS

| | | | | | |
|---|---|---|---|---|---|
| 95,794 | A | * | 10/1869 | Graves | 55/323 |
| 133,436 | A | * | 11/1872 | Grassler | 55/307 |
| 352,063 | A | * | 11/1886 | Optenberg | 55/323 |
| 1,230,784 | A | * | 6/1917 | Rice | 55/462 |
| 1,230,827 | A | * | 6/1917 | Duffie | 15/351 |
| 1,363,859 | A | * | 12/1920 | Fetters et al. | 96/240 |
| 1,762,142 | A | | 6/1930 | Breton | |
| 1,847,233 | A | | 3/1932 | Bilde | |
| 2,346,339 | A | * | 4/1944 | Vose | 15/344 |
| 3,371,471 | A | | 3/1968 | Connors | |
| 3,959,844 | A | * | 6/1976 | Cyphert | 15/320 |
| 4,287,635 | A | | 9/1981 | Jacobs | |
| 4,743,363 | A | | 5/1988 | Darrow | |
| 5,199,963 | A | | 4/1993 | Scarp | |
| 5,259,854 | A | | 11/1993 | Newman | |
| 5,343,592 | A | | 9/1994 | Parise | |
| 5,653,880 | A | | 8/1997 | Mouton | |
| 5,837,129 | A | | 11/1998 | Ross, Jr. et al. | |

(Continued)

FOREIGN PATENT DOCUMENTS

JP 52-20669 * 2/1977

(Continued)

*Primary Examiner*—David A Redding
(74) *Attorney, Agent, or Firm*—King & Schickli, PLLC

(57) ABSTRACT

A vacuum cleaner is provided including a housing, a nozzle inlet, a suction generator carried on the housing and a dirt cup carried on the housing. The dirt cup includes a bottom wall, a sidewall, a dirt collection chamber, an air inlet to the dirt collection chamber in the bottom wall and an air outlet from the dirt collection chamber. A method of directing an airstream in a dirt cup is also provided. That method includes directing the airstream upwardly through the dirt cup in an air inlet conduit, discharging the airstream from the air inlet conduit into the dirt cup in a substantially hemihorn torus shape and exhausting the airstream from the dirt cup.

11 Claims, 2 Drawing Sheets

U.S. PATENT DOCUMENTS

| | | | | |
|---|---|---|---|---|
| 5,961,677 | A | 10/1999 | Scott | |
| 6,171,356 | B1 | 1/2001 | Twerdun | |
| 6,195,835 | B1 | 3/2001 | Song et al. | |
| 6,243,912 | B1 * | 6/2001 | Grey | 15/320 |
| 6,391,095 | B1 | 5/2002 | Conrad et al. | |
| 6,428,589 | B1 | 8/2002 | Bair et al. | |
| 6,546,592 | B1 | 4/2003 | Cockburn et al. | |
| 6,588,055 | B2 | 7/2003 | Bair et al. | |

FOREIGN PATENT DOCUMENTS

| | | |
|---|---|---|
| JP | 56-136642 | 10/1981 |
| JP | 56-136650 | 10/1981 |

* cited by examiner

DIRT COLLECTION ASSEMBLY WITH VOLCANIC AIRFLOW

This application claims the benefit of U.S. Provisional Patent Application Ser. No. 60/419,659 filed on Oct. 18, 2002.

TECHNICAL FIELD

The present invention relates generally to the floor care equipment field and, more particularly, to a dirt collection assembly for a vacuum cleaner and a bagless vacuum cleaner incorporating a novel dirt cup.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, an improved vacuum cleaner is provided. That vacuum cleaner comprises a housing, a nozzle inlet, a suction generator carried on the housing and a dirt cup carried on the housing. The dirt cup includes a bottom wall, a sidewall, a dirt collection chamber, an air inlet to the dirt collection chamber in the bottom wall and an air outlet from the dirt collection chamber.

More specifically describing the invention, the vacuum cleaner includes an air inlet conduit extending from the air inlet into the dirt collection chamber. Further, an air deflector is carried on the air inlet conduit. That air deflector includes a support engaging the air inlet conduit and an arcuate air deflector section.

In one possible embodiment, the air deflector may also include an annular screen section. In this embodiment the support contacts the arcuate air deflector section and the annular screen section extends concentrically around the arcuate air deflector section. The support also includes an axial inlet opening and at least one radially directed outlet opening. The radially directed outlet opening directs air outwardly adjacent a concave surface of the arcuate air deflector section.

Still further describing the invention, the air outlet in the dirt cup is an open end opposite the bottom wall. Additionally, a filter element covers the air outlet. More specifically, a filter assembly is received over the air outlet. The filter assembly includes a filter holder and a filter element held in the filter holder. The filter element includes a frame holding a pleated filter material of a type known in the art.

In one possible embodiment the dirt collection chamber is substantially cylindrical in shape. The inlet conduit is concentrically received within the sidewall in the dirt collection chamber. As a result, at least a portion of the dirt collection chamber is annular in shape. The filter holder is annular and engages an exposed edge of the sidewall. The filter holder includes a body incorporating a lip defining a cavity holding the filter element. Additionally, the filter holder includes a tongue and the sidewall of the dirt cup includes a groove. The tongue and groove mate together when the filter holder is mounted on the dirt cup.

Still further, the housing may include a nozzle section including the nozzle inlet and a canister section. The nozzle section and the canister section are pivotally connected together in this embodiment to provide an upright vacuum cleaner.

In accordance with still additional aspects of the present invention, several novel methods are provided. The first of the methods relates to the routing of air through a vacuum cleaner. This method includes the steps of drawing air into the vacuum cleaner through a nozzle, directing air from the nozzle into a dirt cup through a bottom wall of the dirt cup and exhausting clean air from the vacuum cleaner.

The second method relates to the directing of the airstream in the dirt cup. The second method includes the steps of directing the airstream upwardly through the dirt cup in an air inlet conduit, discharging the airstream from the air inlet conduit into the dirt cup in a substantially parabolic pattern and exhausting the airstream from the dirt cup.

The third method also relates to the directing of an airstream in a dirt cup. This method includes the steps of directing the airstream upwardly through the dirt cup in an air inlet conduit, discharging the airstream from the air inlet conduit into the dirt cup in a substantially hemihorn torus shape and exhausting the airstream from the dirt cup.

Finally, the present invention also includes a dirt collection assembly. That assembly comprises a dirt cup including a sidewall, a bottom wall, an air inlet in the bottom wall and an air outlet.

In the following description there is shown and described a preferred embodiment of the invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
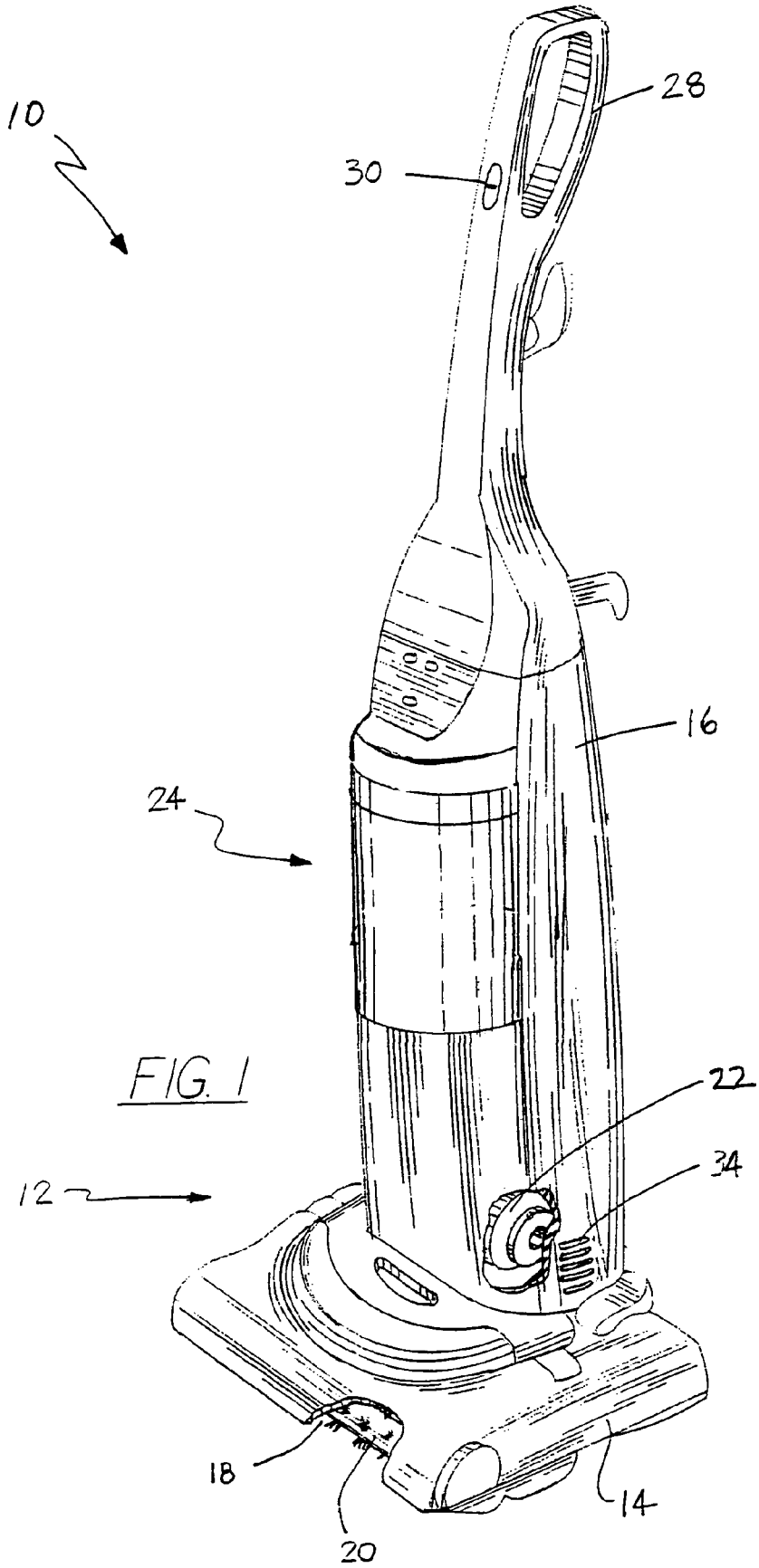
FIG. 1 is a perspective view of one possible embodiment of the vacuum cleaner of the present invention.

Reference is now made to FIG. 1 illustrating one possible embodiment of the vacuum cleaner 10 of the present invention. The illustrated embodiment is an upright vacuum cleaner 10. It should be appreciated, however, that the present invention also includes and this patent also covers canister and hand-held vacuum cleaners.

The vacuum cleaner 10 includes a housing, generally designated by reference numeral 12, including a nozzle section 14 and a canister section 16. As is known in the art, the canister section 16 is pivotally connected to the nozzle section 14 to aid the operator in manipulating the vacuum cleaner to and from across the floor. Wheels (not shown) carried on the housing 12 allow the vacuum cleaner 10 to be moved smoothly across the floor.

As illustrated, the nozzle section 14 is equipped with a nozzle inlet 18. In the illustrated embodiment, the nozzle inlet 18 also includes a rotary agitator 20.

The canister section 16 houses a suction generator 22 (i.e. a fan and motor assembly) and a dirt cup 24. The canister section 16 also includes a control handle 28 and an actuator switch 30 for turning the vacuum cleaner 10 on and off and thereby driving the rotary agitator 20 and the suction generator 22.

During the cleaning operation the rotary agitator 20 brushes and beats dirt and debris from the nap of an underlying carpet being cleaned. That dirt and debris is then drawn by the suction generator 22 through the nozzle inlet 18 into the dirt cup 24 where the majority of the dirt and debris and, more particularly, the relatively coarse dirt and debris are collected. Next, the relatively clean air is drawn through the filter assembly 62 where a filter element 66 cleans the air of substantially any remaining fine particles that are able to pass through the dirt cup 24. The airstream is then directed over the motor of the suction generator 22 to provide cooling before being routed through a final filter, to remove any carbon particles stripped from the brushes of the suction generator motor by the airstream, before exhausting the airstream through an exhaust port 34 into the environment.

Figure 2:
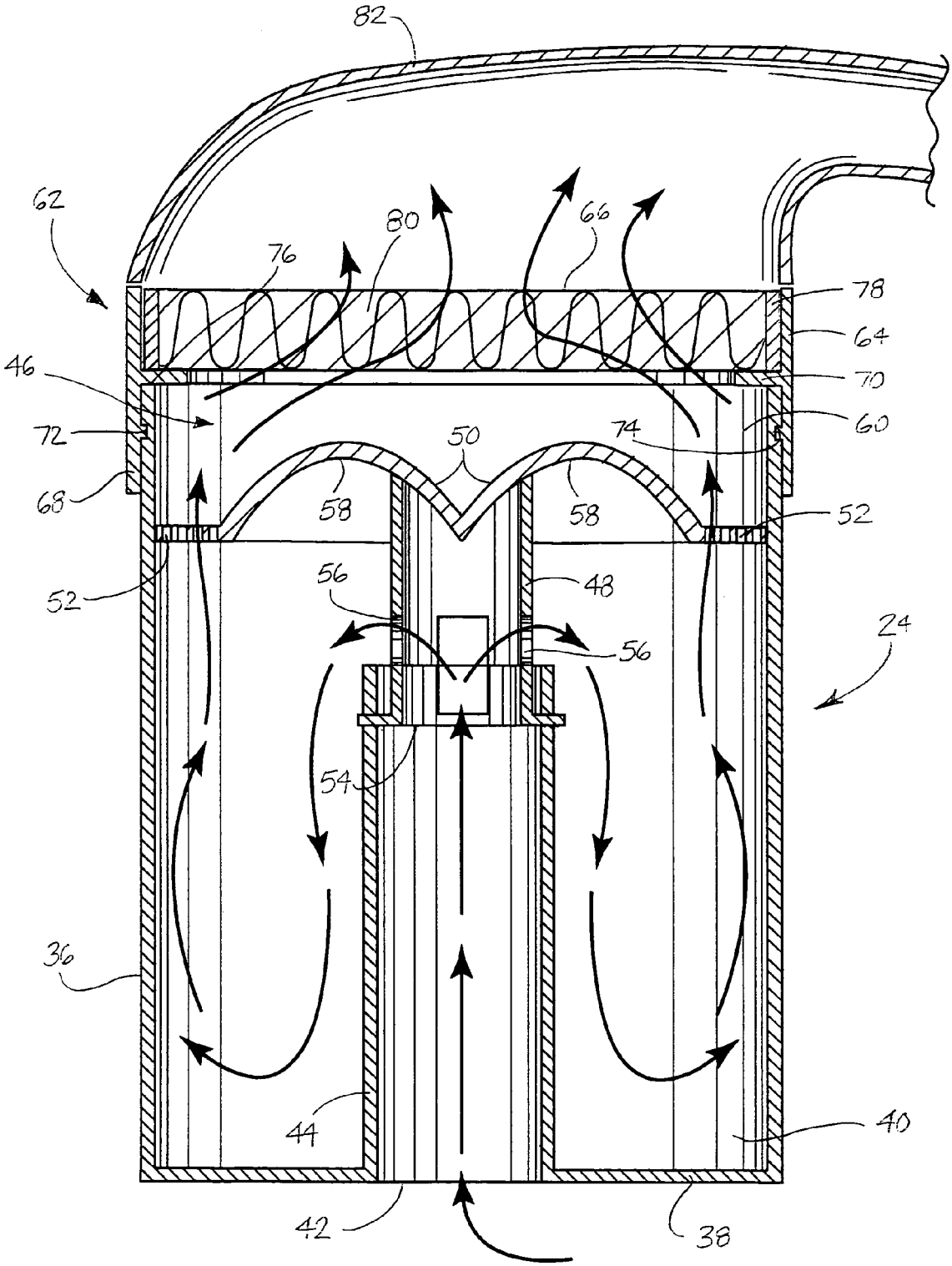
FIG. 2 is a detailed, partially cross-sectional and schematic view illustrating the dirt collection assembly of the present invention including the novel dirt cup and the unique airflow produced by that dirt cup.

As best illustrated in FIG. 2, the dirt cup 24 includes a sidewall 36, a bottom wall 38 and a dirt collection chamber 40. An air inlet 42 is provided in the bottom wall 38. An air inlet conduit 44 extends from the air inlet 42 upwardly into the dirt collection chamber 40. As illustrated, the air inlet conduit 44 is received in the central portion of the dirt collection chamber 40. Where the sidewall 36 and bottom wall 38 define a substantially cylindrical dirt collection chamber 40, the air inlet conduit 44 is concentrically received within that chamber. As a result, at least a portion of the dirt collection chamber 40 is annular in shape.

An air deflector, generally designated by reference numeral 46, is received in the dirt collection chamber 40. More specifically, the air deflector 46 includes a support 48 that is mounted by tabs, cooperating threads or other means to the end of the air inlet conduit 44.

Additionally, the air deflector includes an arcuate air deflector section 50 supported above the bottom wall 38 and the air inlet conduit 44 by the support 48. Still further, the air deflector 46 includes an annular screen section 52 that extends concentrically around the arcuate air deflector section 50 and extends between the air deflector section and the sidewall 36 of the dirt cup 24.

As further illustrated in FIG. 2, the support 48 includes an axial inlet opening 54 in fluid communication with the air inlet conduit 44 and at least one radially directed outlet 56 for directing air outwardly adjacent the concave surface 58 of the arcuate air deflector section 50.

The dirt cup 24 also includes an open end 60 that functions as an air outlet. A filter assembly, generally designated by reference numeral 62, is received over the open end/air outlet 60 of the dirt cup 24. The filter assembly 62 includes a filter holder 64 and a filter element 66 held in the filter holder. The filter holder 64 includes a body 68 and a lip 70 defining a cavity for holding the filter element 66. Additionally, the filter holder 64 includes a tongue 72 and the sidewall 36 includes a groove 74. The filter holder 64 is mounted on and received over the exposed edge 76 at the open end 60 of the dirt cup 24. When properly seated, the tongue 72 and groove 74 mate in order to complete the connection.

In the illustrated embodiment the filter element 66 comprises a frame 78 that holds a pleated filter material 80. The pleated filter material 80 may be of substantially any type well known in the art to be useful for the purposes.

In operation, the rotary agitator 20 beats dirt and debris from the nap of an underlying carpet being cleaned. That dirt and debris is drawn with air into the vacuum cleaner 10 through the nozzle inlet 18 by the suction generator 22. Next that air is directed into the dirt cup 24 through the air inlet 42 and air inlet conduit 44. The air then travels through the support 48 by serially passing through the axial inlet 54 and the radially directed outlet 56. Together, the radially directed outlet 56 and the concave surface 58 of the arcuate air deflection section 50 ensure that the air is discharged into the dirt collection chamber 40 in a substantially hemihorn torus pattern. The resulting shape of the airstream ensures a highly efficient airflow as indicated by the action arrows as illustrated in FIG. 2.

Next, the airstream travels through the annular screen section 52 which functions to prevent the passage of relatively coarse dirt and debris. That dirt and debris then collects in the bottom of the dirt collection chamber 40. The air is then drawn through the pleated filter material 80 of the filter element 66. This material functions to remove any remaining relatively fine contaminants from the airstream. The now clean airstream is then drawn into the air transfer manifold 82 before being routed over the motor of the suction generator 22 in order to provide desired cooling. The air is then subjected to final filtration in order to remove any residual carbon that may have been picked up from the brushes of the suction generator motor before being exhausted into the environment through the exhaust port 34.

The foregoing description of the preferred embodiment of this invention has been presented for purposes of illustration and description. It is not intended to be exhaustive or to limit the invention to the precise form disclosed. Obvious modifications or variations are possible in light of the above teachings. For example, the vacuum cleaner may or may not include a rotary agitator. It may also include more than one rotary agitator. Further, while a bagless vacuum cleaner is described and illustrated, it should be appreciated that the dirt cup 24 could be lined with a disposable bag if desired.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A vacuum cleaner, comprising:

a housing;

a nozzle inlet;

a suction generator carried on said housing; and a dirt cup carried on said housing, said dirt cup including a bottom wall, a sidewall, a dirt collection chamber, an air inlet, an air inlet conduit extending from said air inlet into said dirt collection chamber, an air outlet opposite said bottom wall, a filter assembly received over said air outlet, and an air deflector having a substantially hemihorn torus shape, said air deflector including a support engaging said air inlet conduit wherein said support includes an axial inlet opening and at least one radially directed outlet opening for directing air outwardly adjacent a concave surface of said air deflector, and said air deflector further including an annular screen section extending concentrically around said air deflector.

2. The vacuum cleaner of claim 1, wherein said filter assembly includes a filter holder and a filler element held in said filter holder.

3. The vacuum cleaner of claim 2, wherein said filter element includes a frame holding a pleated filter material.

4. The vacuum cleaner of claim 3, wherein said dirt collection chamber is substantially cylindrical in shape.

5. The vacuum cleaner of claim 4, wherein said air inlet conduit is concentrically received within said sidewall in said dirt collection chamber.

6. The vacuum cleaner of claim 5, wherein said filter holder is annular and engages an exposed edge of said sidewall.

7. The vacuum cleaner of claim 6, wherein said filter holder includes a body and a lip defining a cavity holding said filter element.

8. The vacuum cleaner of claim 7, wherein said filter holder includes a tongue and said sidewall includes a groove, said tongue and groove mating when said filter holder is mounted on said dirt cup.

9. The vacuum cleaner of claim 8, wherein at least a portion of said dirt collection chamber is annular in shape.

10. The vacuum cleaner of claim 9, wherein said housing includes a nozzle section including said nozzle inlet and a canister section.

11. The vacuum cleaner of claim 10, wherein said nozzle section and said canister section are pivotally connected together.

* * * * *

UNITED STATES PATENT AND TRADEMARK OFFICE

CERTIFICATE OF CORRECTION

PATENT NO. : 7,343,641 B2
APPLICATION NO. : 10/686920
DATED : March 18, 2008
INVENTOR(S) : Michael J. Shanor It is certified that error appears in the above-identified patent and that said Letters Patent is hereby corrected as shown below:

Claim 2, column 5, line 13, please replace “filler” with -- filter --.

Signed and Sealed this

Seventeenth Day of June, 2008

JON W. DUDAS
*Director of the United States Patent and Trademark Office*